US007563170B2

(12) United States Patent
Bellows et al.

(10) Patent No.: US 7,563,170 B2
(45) Date of Patent: Jul. 21, 2009

(54) CHILD MOTION DEVICE

(75) Inventors: William B. Bellows, Wyomissing, PA (US); James Godiska, Exton, PA (US); Baku Kakuda, Reading, PA (US); Matthew J. Ransil, Richland, PA (US)

(73) Assignee: Graca Children's Products Inc., Exton, PA (US)

( * ) Notice: Subject to any disclaimer, the term of this patent is extended or adjusted under 35 U.S.C. 154(b) by 275 days.

(21) Appl. No.: 11/385,260

(22) Filed: Mar. 20, 2006

(65) Prior Publication Data

US 2007/0111809 A1 May 17, 2007

Related U.S. Application Data

(60) Provisional application No. 60/732,640, filed on Nov. 3, 2005.

(51) Int. Cl.
*A63G 1/08* (2006.01)
*A63G 1/38* (2006.01)

(52) U.S. Cl. ..... 472/29; 472/33; 472/119

(58) Field of Classification Search ..... 472/29, 472/33, 39, 118, 119
See application file for complete search history.

(56) References Cited

U.S. PATENT DOCUMENTS

| | | | | |
|---|---|---|---|---|
| 43,972 | A | 8/1864 | Coldwell | |
| 100,083 | A | 2/1870 | Stephan | |
| 616,697 | A | 12/1898 | Cowles et al. | |
| 1,360,495 | A | 11/1920 | Bugenhagen | |
| 1,707,167 | A | 3/1929 | Marshall | |
| 1,731,658 | A | 10/1929 | Gnuechtel | |
| 1,874,345 | A | 8/1932 | Parrott | |
| 2,371,384 | A | 3/1945 | Dyer et al. | |
| 2,506,890 | A | 5/1950 | Pratt | |
| 2,510,223 | A | 6/1950 | Hart | |
| 2,616,485 | A | 11/1952 | Robbins | |
| 2,704,111 | A | 3/1955 | Wunderlich | |
| 3,147,972 | A | 9/1964 | Borsuk | |
| 3,391,932 | A | 7/1968 | Scalf | |
| 3,558,129 | A * | 1/1971 | Curry | 472/29 |

(Continued)

FOREIGN PATENT DOCUMENTS

| | | |
|---|---|---|
| DE | 2421474 | 11/1975 |

(Continued)

OTHER PUBLICATIONS

English language translation of Japanese patent No. JP 48-68367.

(Continued)

*Primary Examiner*—Kien T Nguyen
(74) *Attorney, Agent, or Firm*—Lempia Braidwood LLC

(57) ABSTRACT

A child motion device has a frame assembly configured to rest on a floor surface. The device also has a drive system and a cantilevered arm extending from part of the device. The arm is supported above the floor surface and has a driven end coupled to and movable by the drive system and a distal end opposite the driven end. The drive system is configured to pivotally move the arm through a partial orbit around a generally vertical axis of rotation. A child seat is supported on the distal end of the support arm.

26 Claims, 13 Drawing Sheets

U.S. PATENT DOCUMENTS

| | | | | |
|---|---|---|---|---|
| 3,829,086 | A | 8/1974 | Lelong | |
| 4,155,548 | A | 5/1979 | Smith et al. | |
| 4,226,467 | A | 10/1980 | Boudreau | |
| 4,258,446 | A | 3/1981 | McAllister | |
| 4,620,334 | A | 11/1986 | Robinson | |
| 4,805,902 | A | 2/1989 | Casagrande | |
| 4,911,499 | A | 3/1990 | Meeker | |
| 5,303,433 | A | 4/1994 | Jang | |
| 5,403,239 | A | 4/1995 | Zimmers | |
| 5,451,093 | A | 9/1995 | Petrie et al. | |
| 5,688,211 | A | 11/1997 | Myers | |
| 5,707,294 | A | 1/1998 | Fischer | |
| 5,803,817 | A | 9/1998 | Stern | |
| 5,833,545 | A | 11/1998 | Pinch et al. | |
| 6,027,409 | A | 2/2000 | Favorito et al. | |
| 6,254,490 | B1 | 7/2001 | Lawson et al. | |
| 6,318,803 | B1 | 11/2001 | Garland | |
| 6,343,994 | B1 | 2/2002 | Clarke | |
| 6,574,806 | B1 | 6/2003 | Maher | |
| 6,626,766 | B1 * | 9/2003 | Hsia | 472/119 |
| 6,811,217 | B2 | 11/2004 | Kane et al. | |
| 6,854,799 | B1 | 2/2005 | Asbach et al. | |
| 6,932,709 | B1 | 8/2005 | Gubitosi et al. | |
| 7,258,617 | B2 * | 8/2007 | Chen | 472/118 |
| 2002/0113469 | A1 | 8/2002 | Stern et al. | |
| 2005/0101219 | A1 | 5/2005 | Paesang et al. | |
| 2006/0012230 | A1 | 1/2006 | Kennedy | |
| 2007/0040431 | A1 | 2/2007 | Bapst et al. | |

FOREIGN PATENT DOCUMENTS

| | | |
|---|---|---|
| DE | 3834934 | 4/1990 |
| GB | 1 163 624 | 9/1969 |
| GB | 2 312 374 | 10/1997 |
| JP | 48068367 | 9/1973 |
| JP | 60014819 | 1/1985 |
| WO | WO 03/079861 | 10/2003 |
| WO | WO 2006/096712 | 9/2006 |

OTHER PUBLICATIONS

English language translation of German patent No. DE 24 21 474.
Fisher-Price Nature's Touch Baby Papasan Cradle Swing, Product # G2609, 2006; 2 pages; www.fisher-price.com.
International Search Report and Written Opinion issued Apr. 16, 2007 in International application No. PCT/US2006/060469.

* cited by examiner

CHILD MOTION DEVICE

RELATED APPLICATION DATA

This patent claims priority benefit of U.S. Provisional Patent Application Ser. No. 60/732,640, which was filed on Nov. 3, 2005, and the contents of which are incorporated herein by reference.

BACKGROUND OF THE INVENTION

1. Field of the Disclosure

The present disclosure is generally directed to child motion devices, and more particularly to a device for supporting a child and imparting a non-traditional swinging, bouncing, swaying, gliding, or other motion to the child.

2. Description of Related Art

Child motion devices such as conventional pendulum swings and bouncers are known in the art. These types of devices are often used to entertain and, sometimes more importantly, to sooth or calm a child. A child is typically placed in a seat of the device and then the device is used to swing the child in a reciprocating pendulum motion. In the case of a bouncer, a child is placed in the seat and vertical oscillating movement of the child results from the child's own movement or external force applied to the seat by someone else such as a parent.

Research has shown that many babies or children are not soothed or calmed down by these types of motion, but that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions.

Many types of child motion devices are known that are not readily and compactly foldable for storage or stowing away. Additionally, currently known child motion devices do not typically enable multiple different optional seating positions and arrangements for the child or optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child. Additionally, the drive takes up space above the seat, which can make it difficult for an adult to position a child in the device.

Other alternative motion devices are known as well. For example, Fisher-Price manufactures a pendulum swing with a motor above the child's head. The seat of the swing can be oriented in one of two optional seat facing directions by rotating the suspended pendulum-type swing arm through a 90 degree angle. Also, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. Its seat moves in a manner such that a component of its travel path includes a side-to-side arcuate path in a somewhat horizontal plane (see FIG. 9 of the patent). U.S. Pat. No. 6,343,994 discloses another child swing wherein the base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

A number of examples are disclosed herein of alternative motion devices for soothing, calming, and/or entertaining children. The disclosed child motion devices solve or improve upon one or more of the problems or difficulties noted above with respect to known motion devices. The disclosed alternative motion devices each generally include a frame assembly that supports a generally horizontally supported, oscillating arm. In one example, a child seat or other child carrying or supporting device can be carried by the support arm and can be moved through an orbit segment or travel arc that lies in a plane that can be parallel to a reference plane defined by a floor surface or tilted or angled slightly relative to the reference plane. In the disclosed examples, the support arm has a driven end coupled to a drive system that reciprocally moves the support arm through its travel path.

In one example, the distal or free end of the support arm is configured to accept and support the child seat or other device above the ground surface. In one example, the support arm can include a child seat holder that cooperates with the child seat to permit setting the child seat on the alternative motion device in more than one optional seat orientation. In this way, a child seated in the seat can experience a variety of different motions. In another example, the seat holder can be specifically configured to accept and support a seat or other child carrying device from another product, such as a car seat.

The terms generally, substantially, and the like as applied herein with respect to vertical or horizontal orientations of various components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Figure 1:
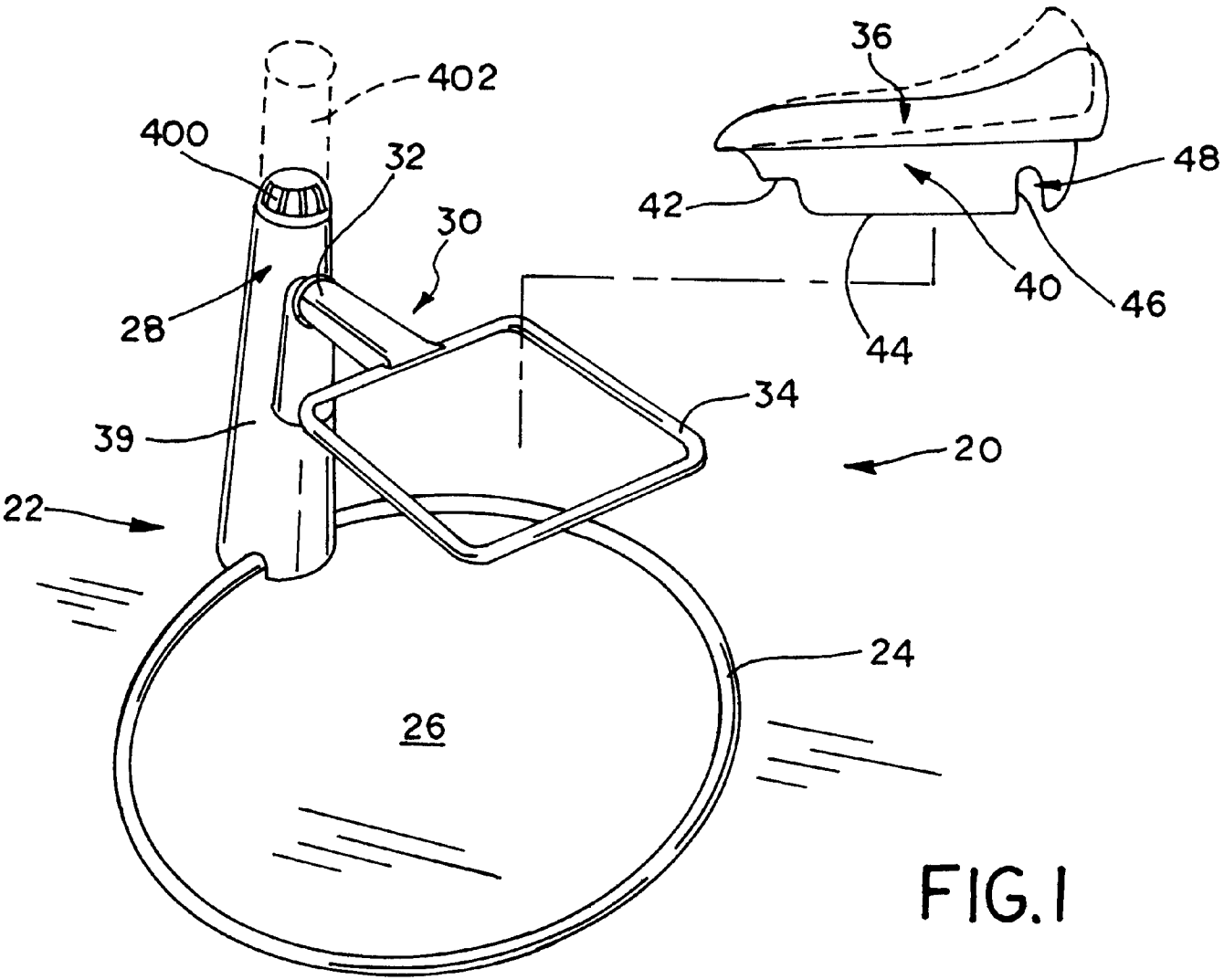
FIG. 1 is a perspective view of a child motion device with a seat in exploded view and constructed in accordance with the teachings of the present invention.

Turning now to the drawings, FIG. 1 shows one example of a child motion device 20 constructed in accordance with the teachings of the present invention. The device 20 in this example generally includes a frame assembly 22 that has a base section 24 configured to rest on a floor surface 26. Throughout this detail description, the term "floor surface" is utilized to define both a surface on which the device rests when in the in-use configurations and a reference plane for comparison to other aspects and parts of the invention for ease of description. However, the invention is not intended to be limited to use with only a specifically horizontal orientation of either the base section of its frame assembly or the reference surface. Instead, the floor surface and the reference plane are utilized to assist in describing relationships between the various components of the device 20.

The child motion device 20 shown in FIG. 1 also has an upright riser, post, or spine 28 that extends upward from a part of the base section 24. In this example, the spine 28 is oriented in a generally vertical orientation relative to its longitudinal length. Any of the spines disclosed herein can have a housing or cover configured in any desired or suitable manner. The housing can be ornamental, functional, or both. The cover can also be removable to access the inner workings of the device if needed. The spine can vary considerably in orientation, shape, size, configuration, and the like from the examples disclosed herein.

In this example, a support arm 30 is cantilevered from the spine 28 and extends generally outward in a radial direction from the spine. In this example, the support arm 30 has a driven end 32 coupled to a portion of the spine 28. The support arm 30 is mounted for pivotal, side-to-side movement about its driven end through a travel path that is substantially horizontal. As described below, the support arm can travel through a partial orbit or arc segment of a predetermined angle and can rotate about an axis of rotation R, which can be offset from a vertical reference and which can be offset from an axis of the spine. Alternatively, the axis of rotation can be aligned with the vertical reference, the axis of the spine, or both if desired. As described below, the driven end is coupled to a drive system designed to reciprocate or oscillate the support arm. The support arm 30 in this example also has a distal end 33 with a seat holder 34 configured to support a child seat 36 for movement with the support arm.

The various components of the child motion device 20 shown in FIG. 1 and the various alternative embodiments of child motion devices described herein can vary considerably and yet fall within the spirit and scope of the present invention. A small number of examples are disclosed to illustrate the nature and variety of component configurations. In the example of FIG. 1, the base section 24 of the frame assembly 22 is in the form of a circular hoop sized to provide a stable base for the device 20 when in use. The configuration of the base section 24 can vary from the hoop shown in FIG. 1 as discussed later. The base section 24 is positioned generally beneath the seat holder 24 in order to offset the load or moment applied to the spine and created by a child placed in a seat of the cantilevered support arm. Similarly, the seat holder 34 can vary considerably and yet fall within the spirit and scope of the present invention. In this example, the seat holder 34 is a square or rectangular ring of material surrounding an opening 38. Other configurations and constructions of the seat holder 34 are also possible, and various alternative examples are illustrated herein. In this example, the spine 28 includes an external housing 39 that can be configured to provide a pleasing or desired aesthetic appearance. The housing 39 can also act as a protective cover for the internal components, such as the drive system, of the device 20.

In one example of the invention, the seat holder 34 is configured to permit the child seat 36 to be mounted on the support arm 30 in a number of optional orientations. In this example, the child seat 36 can have a contoured bottom or base 40 with features configured to engage with portions of the seat holder 34 so that when it is rested on the seat holder, the child seat 36 is securely held in place. In this example, the seat holder is formed of tubular, linear side segments. The seat bottom has a flat region 42 on one end that rests on one linear side segment of the holder 34. A depending region 44 of the seat base 40 is sized to fit within the opening 38 of the holder. The other end of the base 40 has one or more aligned notches 46 that are configured to receive the opposite linear side segment of the holder. The depending region 44 and the notches 46 hold the child seat 36 in place on the holder. Gravity alone can be relied upon to retain the seat in position. In another example, one or more positive manual or automatic latches 48 can be employed in part of the seat, at one or both ends of the seat, as part of the seat holder 34, and/or at one or both ends of the seat holder to securely hold the child seat 36 in place on the seat holder 34. The latches 48 can be spring biased to automatically engage when the seat is placed on the holder.

Geometry and symmetry can be designed into the holder and seat to permit the seat to be placed in the holder in multiple optional seat orientations. As represented by dashed lines in FIG. 1, the seat and/or the seat holder can also be configured to permit the seat or holder incline to be adjusted to various recline angles. In another example, the holder and/or the seat can be cooperatively designed to permit the seat or other child supporting device to be rotated between fewer than four, more than four, or even an infinite number of seat facing orientations when placed on the holder. Cooperating discs on the two parts could be employed to achieve infinite orientation adjustment.

Figure 2:
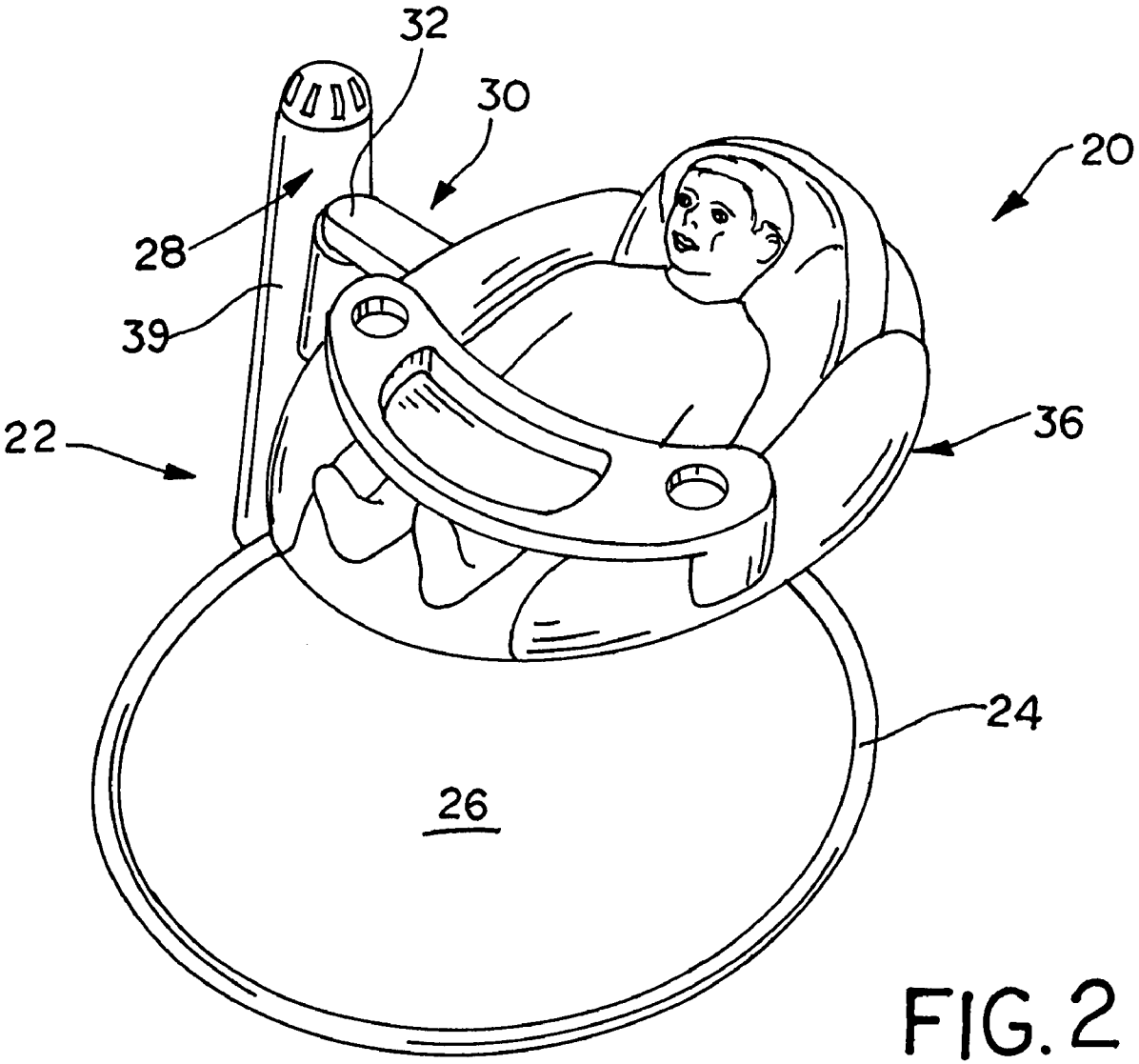
FIGS. 2-5 are perspective views of the child motion device shown in FIG. 1 and each showing a child seat mounted in a different one of a plurality of optional seating orientations.
Figure 3:
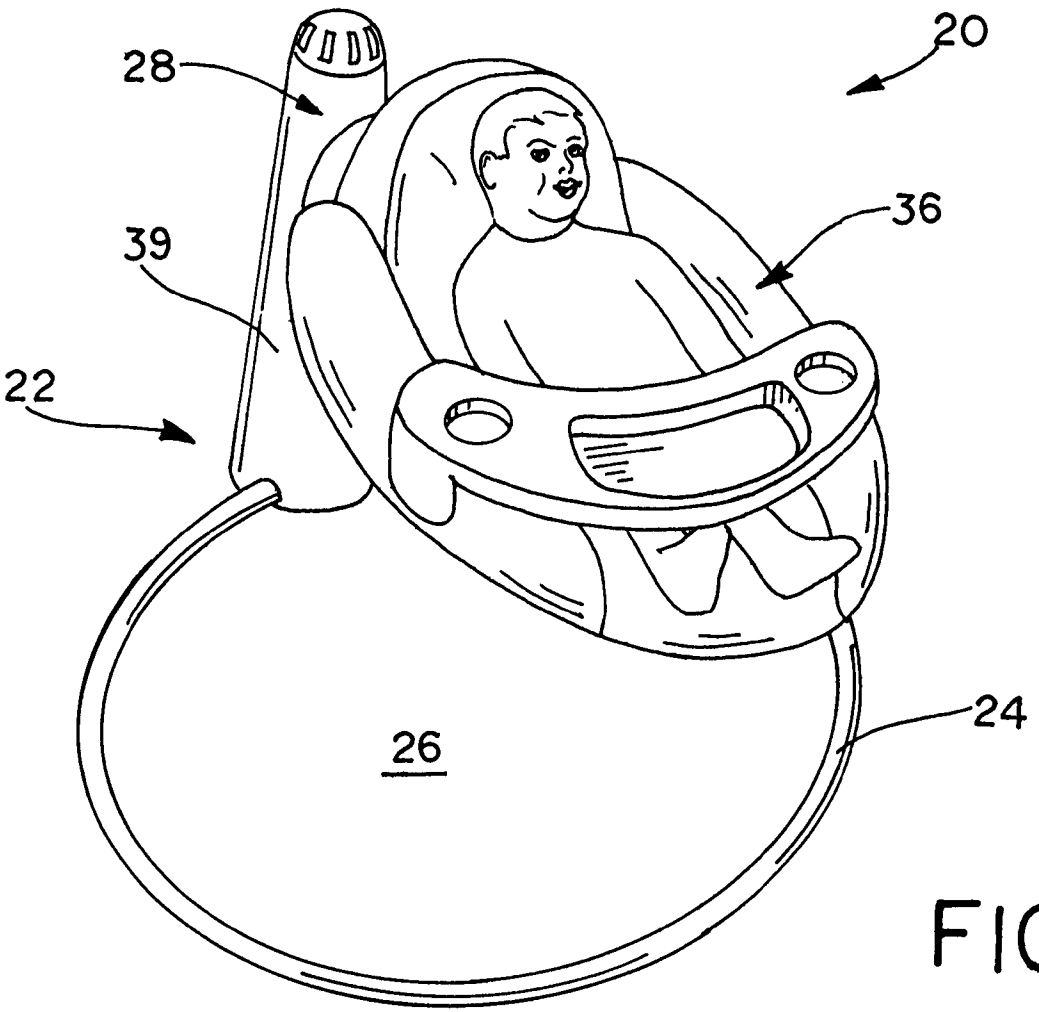
Figure 4:
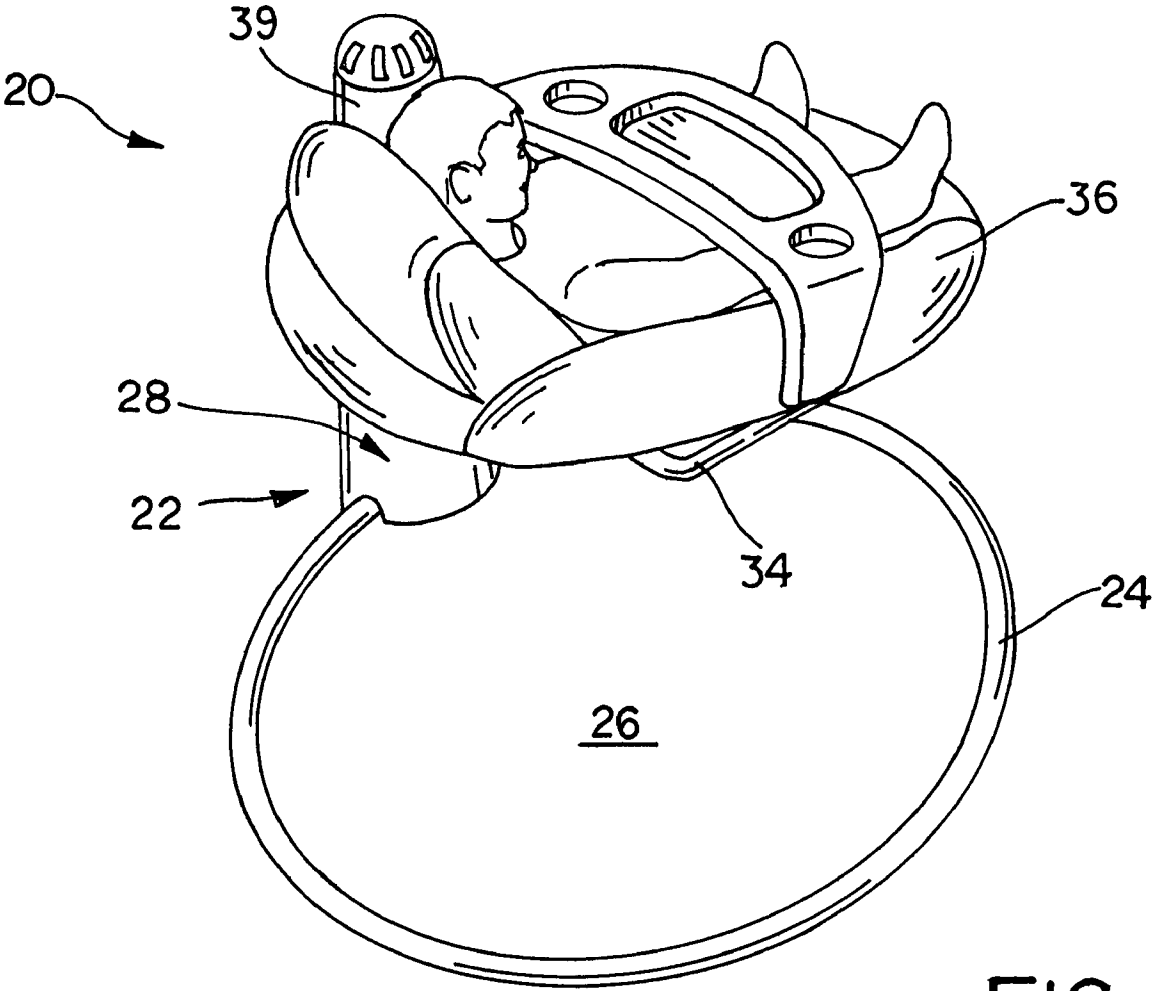
Figure 5:
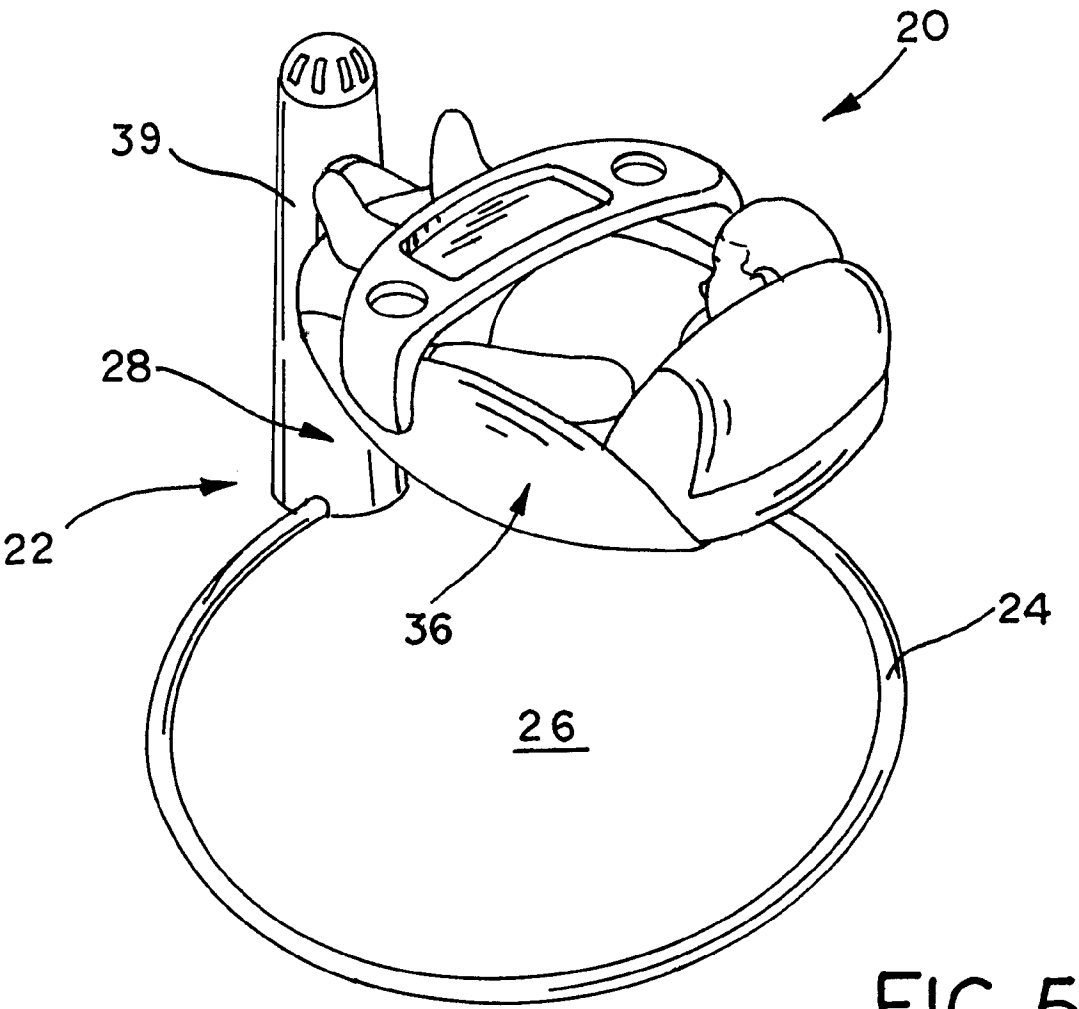

FIGS. 2-5 illustrate one example of an array of optional child seat orientations permissible by the square shape of the seat holder 34 in this example. As shown in FIG. 2, the child seat 36 can be positioned on the seat holder 34 of the support arm 30 with the axis of rotation R positioned on the right had side of the child. FIG. 3 shows another optional seating orientation where the position of the axis of rotation R is located behind the child seat. FIG. 4 shows another optional seating orientation where the position of the rotation axis R is on the left hand side of the child seat. FIG. 5 shows a further alternative seating orientation wherein the child seat faces the position of the rotation axis R of the support arm. By placing the seat 36 in different orientations in the holder, the child can experience different relative motions and a variety of different visual environments without changing the support arm travel characteristics.

The child motion device depicted generally in FIGS. 1-5 is constructed according to the invention to simulate or mimic various movements that might be employed by a mother or father as they hold a child in their arms. An adult holding a child will often alternate raising and lowering their shoulders or pivoting their torso from side-to-side to simulate a rocking movement. Other times, an adult may hold the child in their arms and twist their torso from side-to-side creating a motion for the child through a segment of an arc. Other times, the adult may simply sway the child back and forth by laterally moving their elbows from side to side while holding the child. Sometimes an adult may employ a combination of such movements and/or may lean forward and tilt their spine at an angle toward the child when doing these motions.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements. Parents usually hold their child and move them in a slow, even rhythm to help calm or soothe the child. The disclosed devices can be constructed to operate in a manner that also mimics the degree and frequency of motion that a child might experience when held in an adult's arms.

Figure 6A:
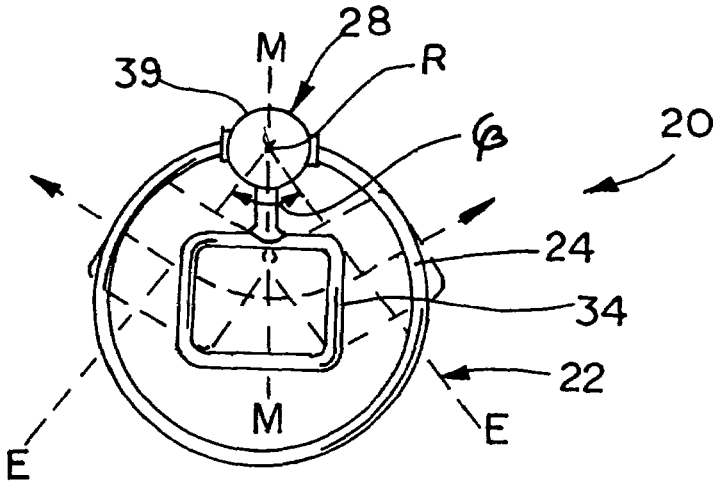
FIG. 6A is a schematic top view of a child motion device constructed in accordance with the teachings of the present invention and shows an example of the orbital or circumferential arc of the swing arm motion for the child motion devices disclosed herein.

The various motions for the disclosed devices herein can be achieved in a wide variety of ways. FIGS. 6A-8B illustrate a few examples of alternative child motion device constructions and arrangements. FIG. 6A shows a top view of the child device 20. As shown, the support arm 30 can rotate and reciprocate through an arc of travel less than a full circle. In one example, the support arm 30 can rotate between two extremes E through an angle β of 120 degrees. This angle can vary, can be greater than 360 degrees, can be less than 120 degrees, and yet can fall within the spirit and scope of the invention. The support arm 30 is described herein as being substantially horizontal and the rotation axis R as being substantially vertical herein, even though they can be angularly offset from these references, as is illustrated in a number of the drawing figures herein.

Figure 6B:
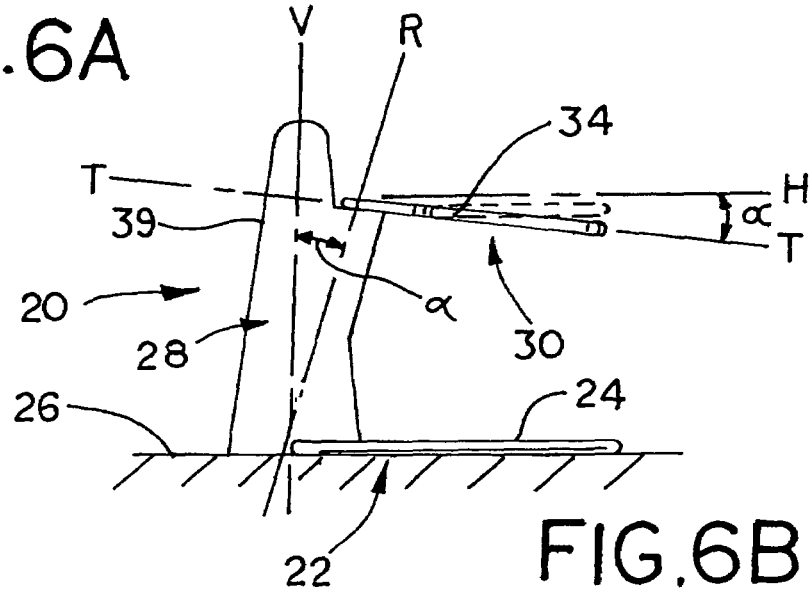
FIGS. 6B and 6C are schematic side views of alternative examples of a child motion device constructed in accordance with the teachings of the present invention and that provide different swing arm motion alternatives.
Figure 6C:
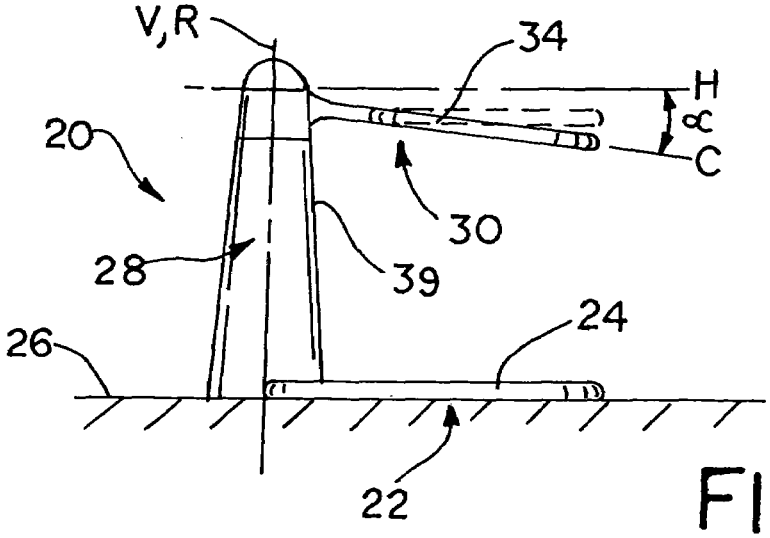

FIGS. 6B and 6C show alternative arrangements for the device 20 to product slightly different motions. As shown in FIGS. 6B and 6C, the support arm 30 can rotate about an axis of rotation R. The axis of rotation R can be aligned with a vertical axis V relative to the reference plane, as shown in FIG. 6C. However, in the example shown in FIG. 6B the support arm 30 and its axis of rotation R tilt at an angle a relative to the horizontal reference H and is perpendicular to its axis of rotation R. In one example, this angle can be about 15 degrees, but the angle can be less than 15 degrees, 0 degrees, or greater than 15 degrees, and yet fall within the spirit and scope of the invention. The support arm and/or the axis of rotation can even be tilted away from the travel arc if desired.

In a vertically offset arrangement, the support arm will sweep through its arc or travel in a plane that is tilted to horizontal. The actual motion of the seat holder 34 will thus have a rotational component about its axis R as well as a vertical component. The holder 34 will vary in positional height between a low elevation point and a high elevation point as it moves along the path within the tilted travel plane T. These elevations can be set to occur anywhere along the travel arc, depending upon where the mid-point M of the travel arc of the seat holder is designed to occur. If the mid-point M of the travel arc is set at the lowest elevation of the travel plane T defined by the seat holder travel arc, equal high points will occur at the opposite extremes E of the arc. This configuration may best simulate the motion that a child might experience when held in their parent's arms.

In FIG. 6C, another motion alternative is shown. In this example, the axis of rotation R is precisely vertical and colinear with the vertical reference axis V (as well as the spine axis in this example). However, in this example the support arm is tilted at an angle a downward from a horizontal reference H. The seat holder will thus travel in a horizontal plane through a circular arc. The support arm 30 will thus move through an arc of a segment of a cone C and not in a plane. The child seat holder 34 in this example is tilted slightly away from the spine 28. Alternatively, the seat holder 34 can be oriented parallel to the horizontal reference H, if desired. This is also true for the example of FIG. 6B as long as the child seat remains on the side of the spine wherein the travel plane T is below the horizontal reference H.

In any of these examples, the support arm 30 can be bent such that, at least at the low elevation point, or the mid-point, of the travel arc, the seat is oriented level with the floor surface or horizontal. FIGS. 6A and 6B show such a seat holder orientation in dashed line. The seat holder angle relative to the support arm can vary and can even be adjustable to provide additional motion alternatives for the seat occupant.

Figure 7B:
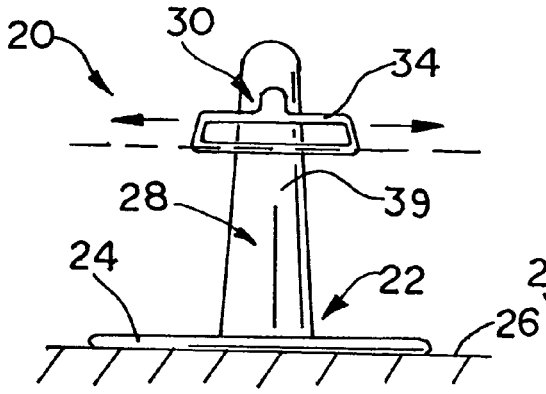
FIGS. 7A and 7B are schematic front views of alternative examples of a child motion device constructed in accordance with the teachings of the present invention and that provide other different swing arm motion alternatives.
Figure 7A:
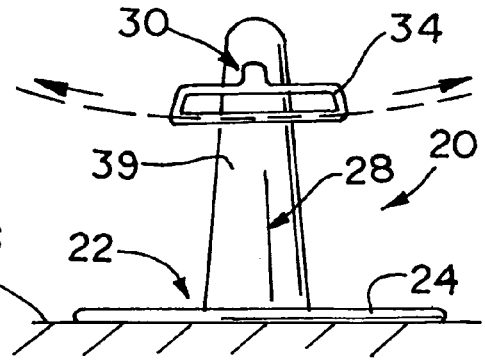

FIGS. 7A and 7B are front views that also depict alternative motions that can be incorporated into the device 20. The front view of FIG. 7A is representative in one example of the travel path for the child seat of the device shown in FIG. 6B. The seat holder will travel both side to side and will sweep through an arc with both a horizontal component and a vertical component to its motion. This is because the support arm 30 moves in a travel plane T tilted at an angle a relative to the horizontal reference. The front view of FIG. 7B is representative of the travel path for the child seat of the device shown in FIG. 6C. The child seat of this device will move in a horizontal travel plane.

FIG. 7A can represent other motion alternatives as well. Cam surfaces at the driven end 32 of the support arm 30 can be designed, or other mechanical means can be employed, in the device 20 to impart optional vertical movement of the support arm as it sweeps through its travel arc. The arm can be caused to vertically move in the direction of its rotation axis R (see FIG. 8A as representative of the motion) or vertically pivot (see FIG. 8B as representative) as it reciprocates from side-to-side and according to its position along its travel arc. In one example, a four-bar or other mechanical linkage arrangement can be employed in the drive system or even in the support arm and/or the holder construction. Such linkage arrangements could be employed to create optional motions in different directions including pivoting vertical movement of the arm, linear vertical movement of the arm, longitudinal movement of the arm, longitudinal rotation of the arm, or the like.

Figure 8A:
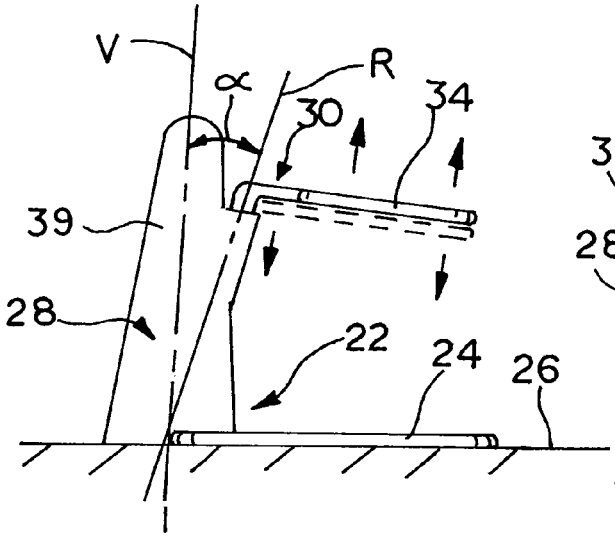
FIGS. 8A and 8B are schematic side views of other alternative examples of a child motion device constructed in accordance with the teachings of the present invention and that provide other different swing arm motion alternatives.
Figure 8B:
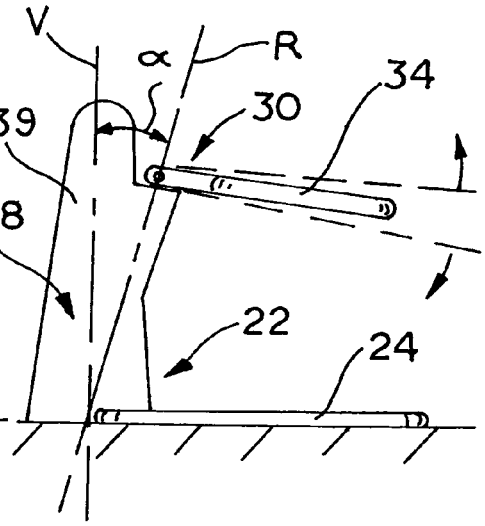

FIGS. 8A and 8B also are representative of vertically reciprocating or bouncing motion. The bouncing or oscillating vertical motion can be imparted using a spring, as is described below as well. The bouncing motion feature can optionally be designed as a separate motion option for the device, such that the child seat can be bounced even while the support arm does not reciprocate rotationally, or as an additional motion that can only occur along with rotational movement of the support arm. The vertical motion can again be angular as shown in FIG. 8B, or can be linear as shown in FIG. 8A.

The type and complexity of the motion characteristics imparted to the support arms disclosed herein can vary and yet fall within the spirit and scope of the invention. If desired, the support arm can, for example, also be designed to travel through 360 degrees or more before changing directions. The seat holder 34 and/or the support arm 30 can also be angularly adjustable if desired, to further alter the motion experienced by a seat occupant. FIG. 8B is also representative of one example of this type of adjustment feature that can be optionally added to disclosed devices. Additionally, the support arm can be length adjustable, if desired, to create even more motion versatility in the device 20. Alternatively, the seat position can be slidably adjustable or location-specific adjustable along the support arm from the distal end inward toward the driven end.

Figure 9:
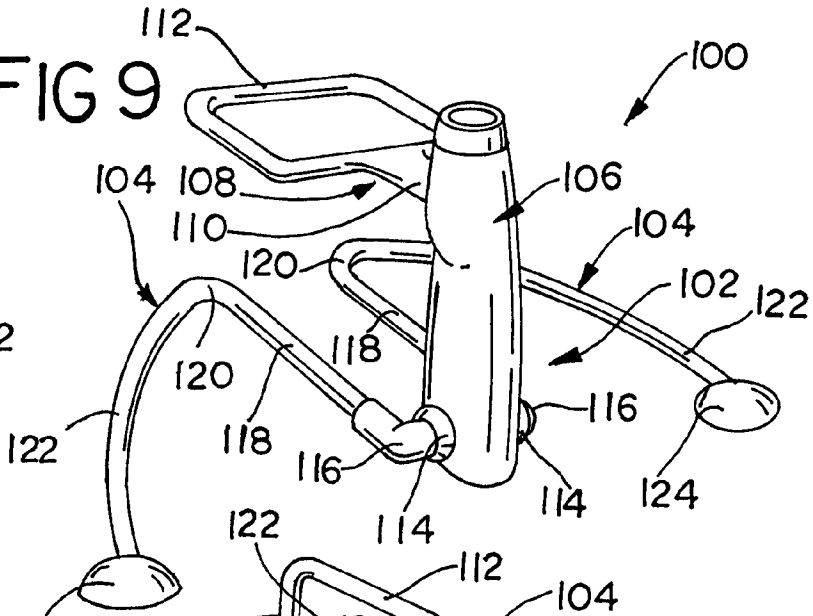
FIG. 9 is a rear perspective view of another example of a child motion device, minus the seat, and constructed in accordance with the teachings of the present invention.
Figure 11:
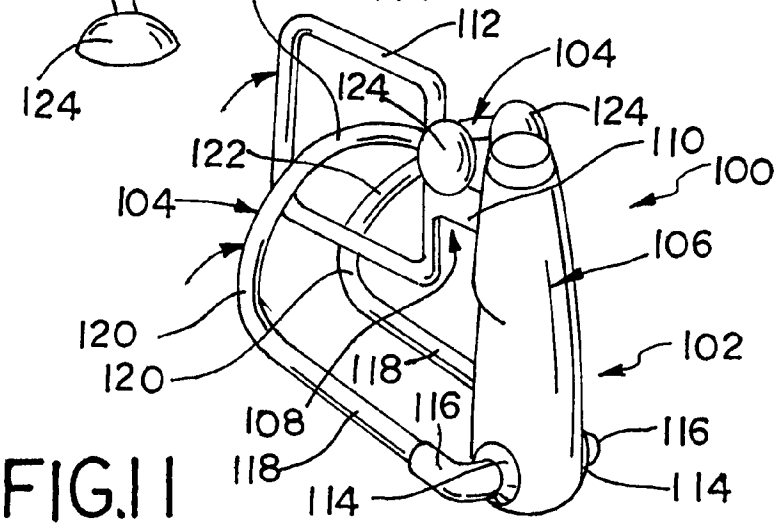
FIG. 11 is a perspective view of an alternative example of the child motion device shown in FIG. 9 and folded to a different compact configuration.
Figure 10:
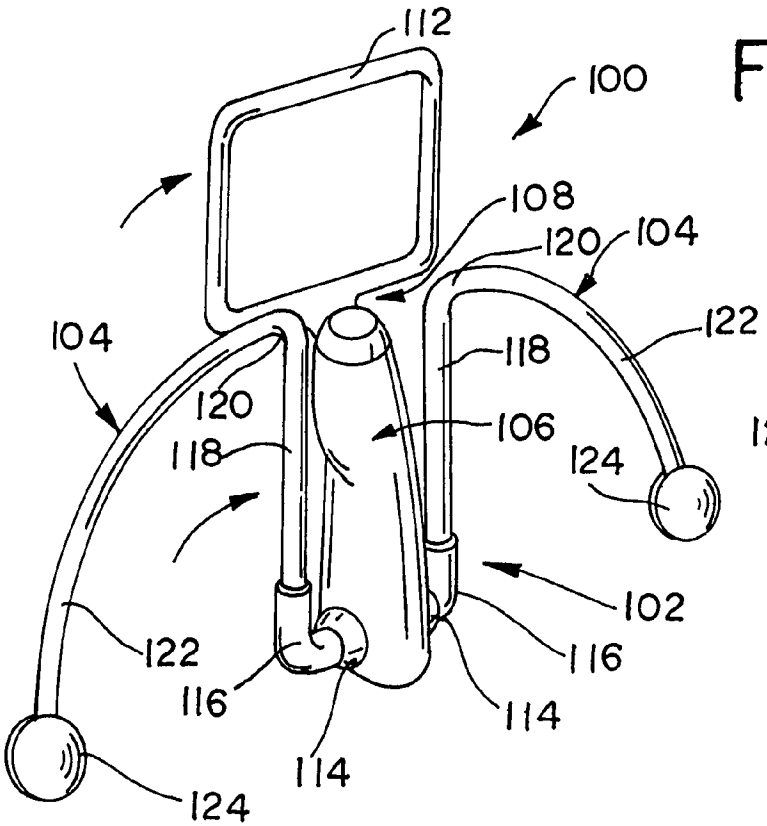
FIG. 10 is a perspective view of one example of the child motion device shown in FIG. 9 and folded to one compact configuration.

FIGS. 9-11 illustrate one alternative example of a child motion device 100 constructed in accordance with the teachings of the present invention. In these figures, two alternative arrangements for a folded or collapsed configuration of the device 100 are also illustrated. In one example of the present invention, the child motion devices can be moved between a set-up condition such as that shown for the device 100 in FIG. 9, as well as the device 20 in FIG. 1 and a folded or collapsed condition such as those shown in FIGS. 10 and 11 for the device of FIG. 9.

In this example, the child motion device 100 has a frame assembly 102 with a base section having two separate components 104. As with the previous example, the spine 106 extends generally vertically upward when in the set-up configuration shown in FIG. 9. The device 100 in this example also has a support arm 108 configured essentially identically to the support arm 30 in the prior example. However, in this example, a driven end 110 of the support arm 108 is movably coupled to the spine in a manner that permits the support arm to be collapsed or folded to a storage position from the in-use position shown in FIG. 9 where the support arm extends radially outward from the axis of the spine. A seat holder 112 is positioned at a distal end of the arm 108.

The base section components in this and other examples are described herein with reference to their position while in the in-use configuration and lying in floor reference plane. In this example, each of the base section components 104 has a first end 114 that is pivotally connected to a side of the spine 106. Each section 104 also has an elbow near the first end or connected end 114. The connected ends 114 project laterally outward from the spine 106 in this example and then the elbows 116 continue into an elongate linear segment 118 on each part or component 104. The elongate segments 118 project forward relative to the support arm position in the in-use configuration and then continue into an outward bend 120 from which a curved support leg 122 extends. The distal end of the support legs 122 each have a stabilizing foot 124. The feet are sized to increase the surface area of the base section support legs 122 that contact the floor surface when in the in-use configuration of FIG. 9. In this configuration, the base sections 104 in this example extend forward beneath the support arm 108 and then laterally outward opposite from one another to create a stabile base section.

FIG. 10 illustrates one example of a folded configuration for the device 100 shown in FIG. 9. In this example, the base sections 104 pivot about a horizontal axis extending between the two connection ends 114. The base sections 104 can pivot upward so that the elongate linear parts 118 lie vertically adjacent the spine 106. In this same example, the support arm 108 is configured to pivot upward as well so that it lies in a plane essentially close to and parallel with a plane of the spine 106 and the folded up base sections 104. The very thin profile of this folded configuration permits the device 100 to be easily stored in relatively small, thin spaces.

FIG. 11 illustrates an alternative example of a folded configuration that can be employed in the device 100 shown in FIG. 9. In this example, the linear parts 118 pivot about their respective ends that are connected to the elbows 116 and rotate inward toward one another. In this manner, the support legs 122 pivot upward toward one another and the linear parts 118 remain in a downward position against the floor surface. In this same example, the support arm 108 can be moved to a collapsed configuration in a different manner than that shown in FIG. 10. In this example, the support arm 108 rotates longitudinally about its own forward extending axis to a position where its seat holder 112 lies in a vertical plane instead of the horizontal in-use position. Again, the folded configuration shown in FIG. 11 creates a compact device that can be easily stored in a storage space that has a low height and a relatively narrow width profile.

Figure 14:
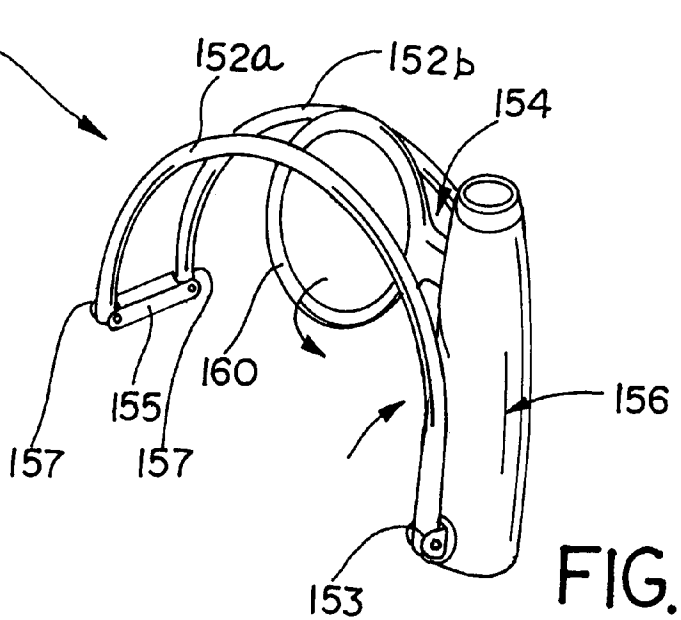
FIG. 14 is a perspective view of another example of the child motion device shown in FIG. 12 and folded to a different compact configuration.
Figure 12:
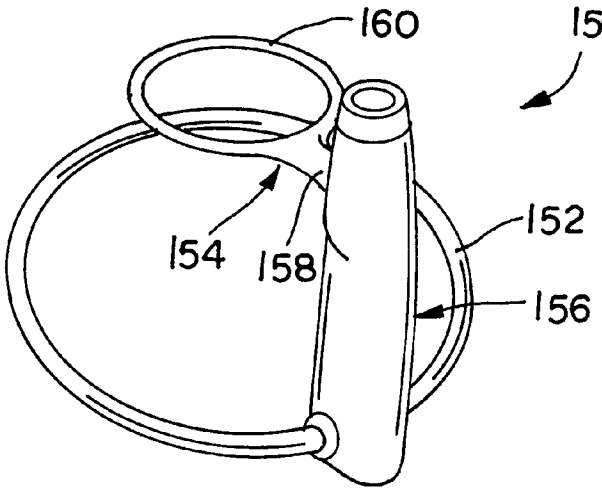
FIG. 12 is a rear perspective view of another example of a child motion device, minus the seat, and constructed in accordance with the teachings of the present invention.
Figure 13:
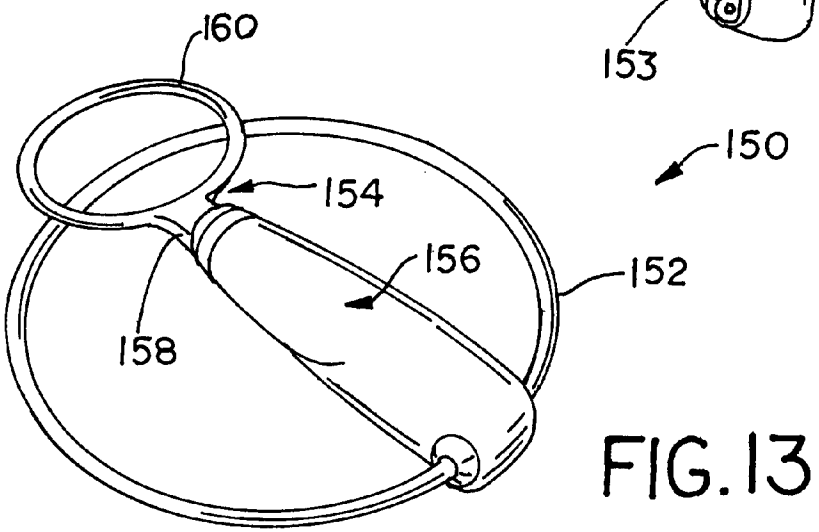
FIG. 13 is a perspective view of one example of the child motion device shown in FIG. 12 and folded to one compact configuration.

FIGS. 12-14 illustrate another example of a child motion device 150 constructed in accordance with the teachings of the present invention. These figures again illustrate two alternative folded or collapsed configurations for the device 150 shown in FIG. 12. In this example, the device 150 has a base section 152 configured as a hoop identical to that shown in the device 20 of FIG. 1. The device 150 also has a support arm 154 again extending radially outward from a spine 156 that projects upward from part of the base section. In this example, the support arm 154 has a driven end 158 coupled to the spine and a seat holder 160 at its distal end. The seat holder 160 in this example is configured as a circular ring surrounding an open space. A child seat (not shown) could have a bottom configured with vertical or angles slots to engage with opposite sides of the ring. With this seat holder configuration, the seat can then be oriented in virtually any rotational position on the seat holder as desired, and not just the four positions shown for the device 20 in FIGS. 2-5.

FIG. 13 illustrates an alternative folded configuration that can be employed with the device 150 shown in FIG. 12. In this example, the base section 152 can be pivotally connected along a generally horizontal axis to the base section 152 so that it can be folded forward into an opening within the hoop of the base section 152. In the same example, the support arm 154 can be pivotally coupled to the spine 156 so that it can be pivoted directly upward toward its rotation axis. When the spine 156 is folded downward toward the base section 152, the support arm 154 can be folded upward against or very close to the spine. When completely folded as shown in FIG. 13, the components can lie generally in the same plane to form a very low height profile. In alternative examples not shown, the support arm 154 could also just as easily be collapsible in parts upon itself and/or could fold downward toward the spine 156.

FIG. 14 illustrates another alternative example of a folded configuration that could be employed with the device 150 shown in FIG. 12. In this example, the base section has two halves 152*a*, each with opposed ends 153 being pivotally attached to opposite sides of the spine. A side of the base sections 152*a* opposite the spine can have a link 155 that pivotally connects free ends 157 of the base section halves. In this example, the two base section halves 152*a* can pivot upward toward one another and lie in generally parallel planes on opposite sides of the spine and project forward in the same direction from the spine. In this same example, the support arm can be rotationally coupled to the spine so that the seat holder 160 can be rotated about its own forward extending axis from a horizontal orientation to a vertical orientation lying in a plane between and parallel to the folded up base section halves.

Figure 16:
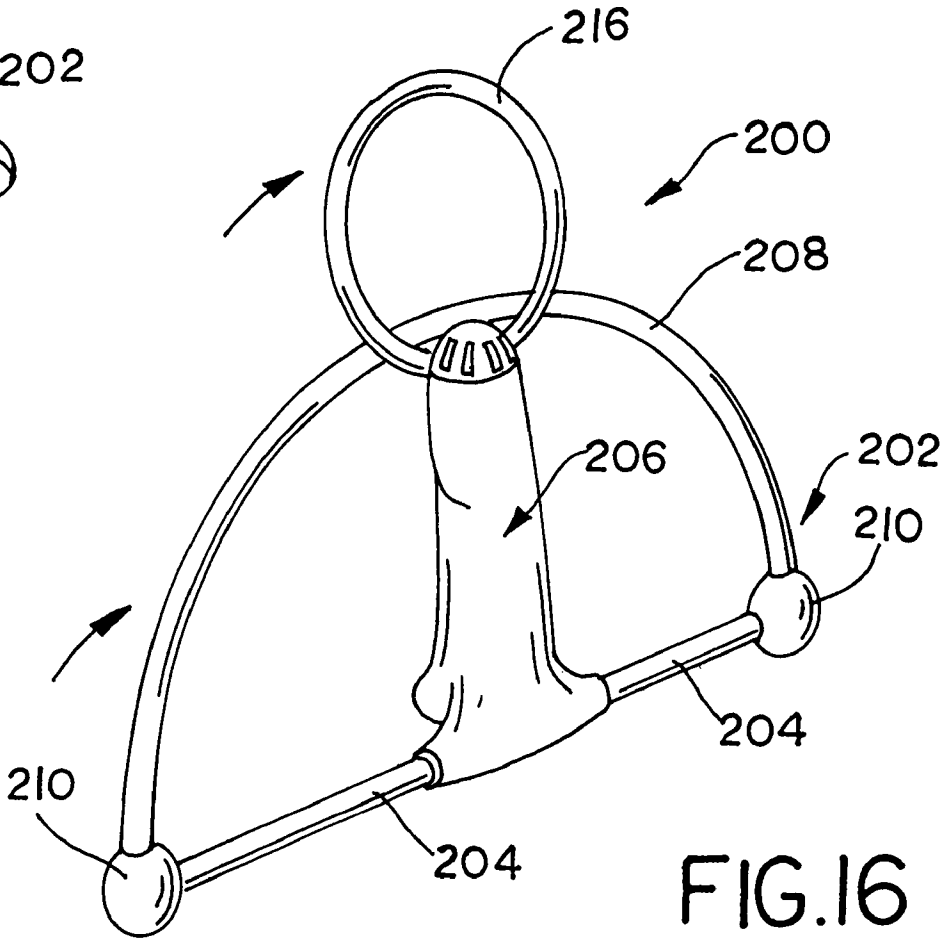
FIG. 16 is a perspective view of one example of the child motion device shown in FIG. 15 and folded to a compact configuration.
Figure 15:
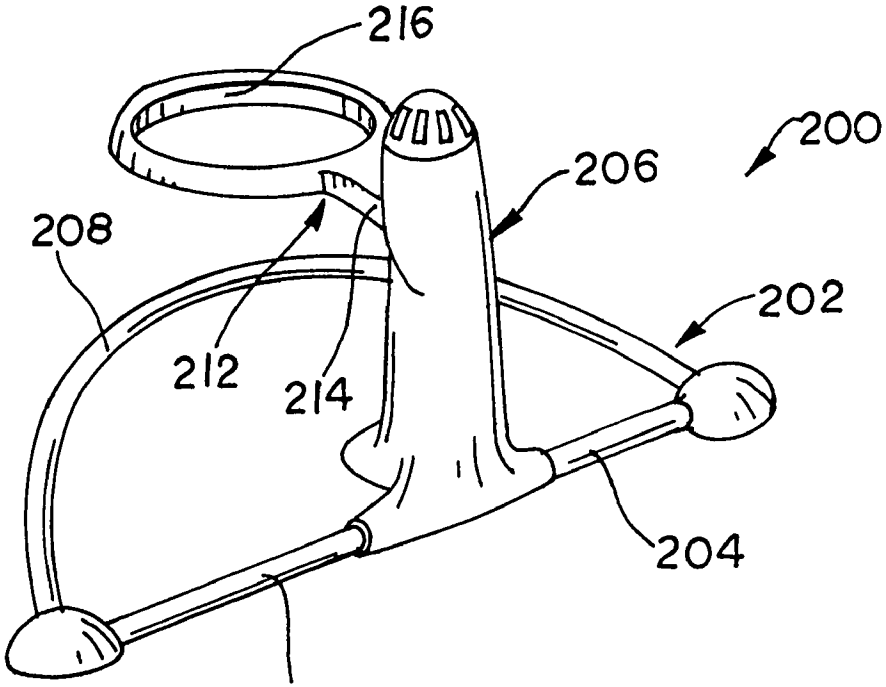
FIG. 15 is a rear perspective view of another example of a child motion device, minus the seat, and constructed in accordance with the teachings of the present invention.

FIGS. 15 and 16 illustrate yet another example of a child motion device 200 constructed in accordance with the teachings of the present invention. These figures illustrate only one alternative folded or collapsed configuration for the device 200, though other configurations are certainly possible. In this example, the device 200 has a base section 202 configured as a D-shaped structure. The base section 202 has a linear part 204 that extends through or beneath a spine 206. In this example, the spine 206 is positioned at about the mid-point of the linear part 204. The base section also includes a curved part 208 in the form of a one-half circle. The ends of the curved part 208 are coupled to the ends of the linear part 204 at knuckles or joints 210. In this example, the joints 210 are separate parts and are formed with large surface area, flat bottoms to assist in adding stability to the child motion device 200. In an alternative example, the D-shaped base section can be one continuous integral component. The device 200 also has a support arm 212 again extending radially outward from the spine 204 and that extends upward from the linear part of the base section 202. In this example, the support arm 212 has a driven end 214 coupled to the spine and a seat holder 216 at its distal end. The seat holder 216 in this example is also configured as a circular ring surrounding an open space, as described above in the examples of FIGS. 12-14.

FIG. 16 shows the device 200 in one example of a folded or collapsed configuration. In this example, the housing of the spine 206 and the linear part 204 of the base section 202 can pivot relative to one another to a generally co-planar position. As with a number of the previous examples, the support arm 212 in this example can also pivot upwards to lie in generally the same plane as the spine and base section. The device 200 also has a very flat, thin profile for easy storage when not in use.

Figure 18:
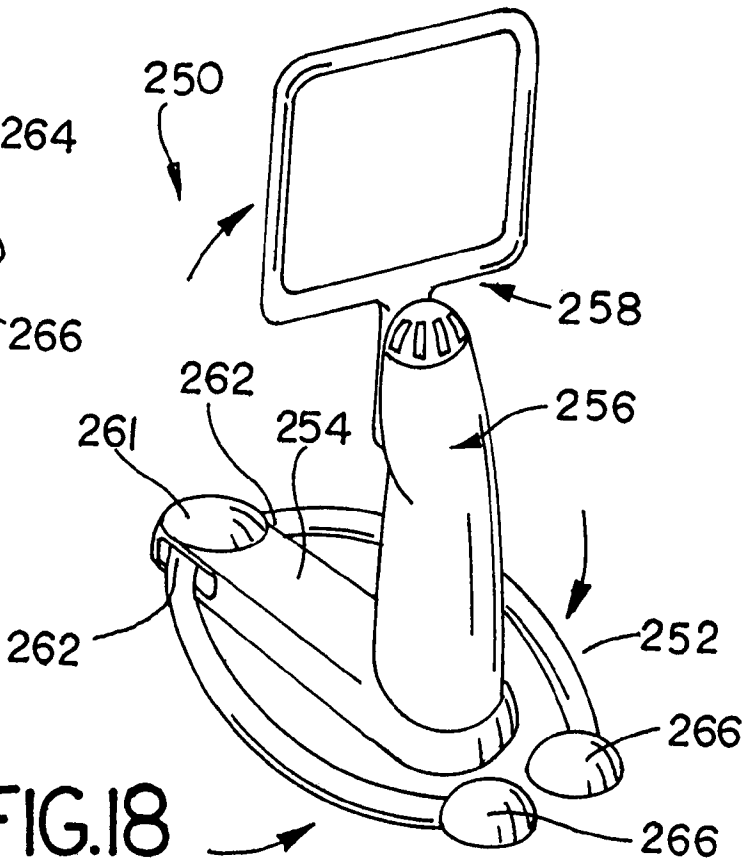
FIG. 18 is a perspective view of one example of the child motion device shown in FIG. 17 and folded to a compact configuration.
Figure 17:
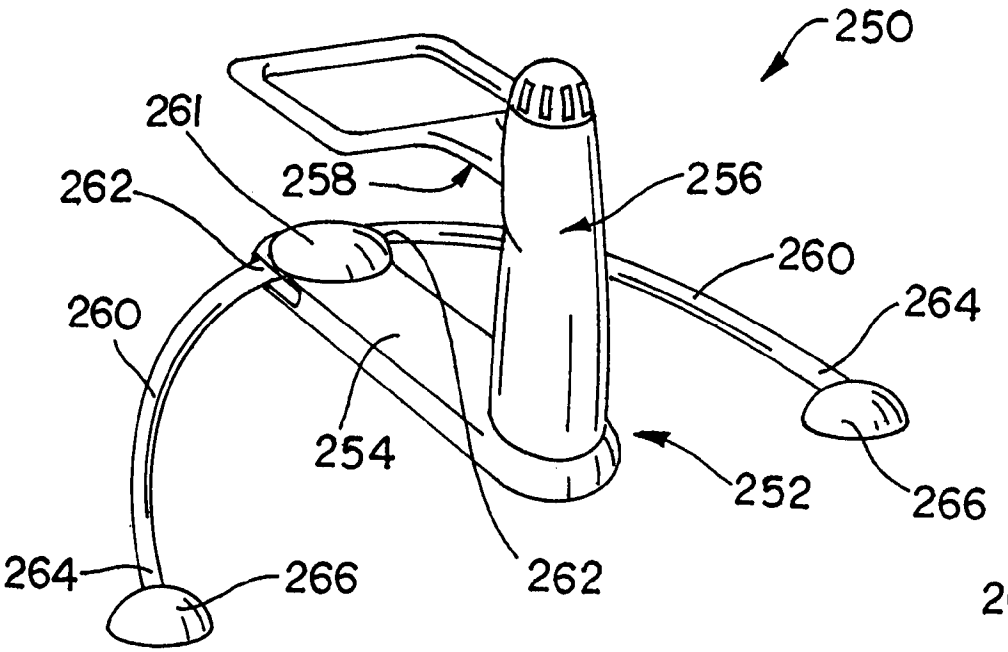
FIG. 17 is a rear perspective view of another example of a child motion device, minus the seat, and constructed in accordance with the teachings of the present invention.

FIGS. 17 and 18 illustrate still another example of a child motion device 250 constructed in accordance with the teachings of the present invention. These figures again illustrate only one alternative folded or collapsed configuration for the device 250, though other configurations are certainly possible. In this example, the device 250 again has a base section 252 to provide stable support for the device when in the set-up configuration as shown in FIG. 17. The base section 252 in this example has a wide, flat leg 254 that extends in a forward direction relative to a spine 256 and a mid-travel position of a support arm 258. The support arm 258 is similar to that of the device 20 of FIGS. 1-5.

The base section 252 also has a pair of bowed parts 260 projecting opposite one another laterally outward from the distal end 261 of the leg 254. Each bowed part 260 has a pivoting end 262 connected to the distal end 261 of the leg 254 and has a free end 264 opposite the pivoting ends. The free ends 264 in this example also each include an end cap or foot 266 with a large, flat bottom surface to add stability for the device when in use. As shown in FIG. 18, the bowed parts 260 can pivot outward away from the leg to an in-use position providing a wide, stable base for the device. When folded, the bowed parts 260 can pivot inward toward the leg 254 to provide a narrower folded size. The support arm 258 in this example can pivot upward as shown, or can rotate from a horizontal plane to a vertical plane along a forward extending axis as described for previous examples.

Figure 19:
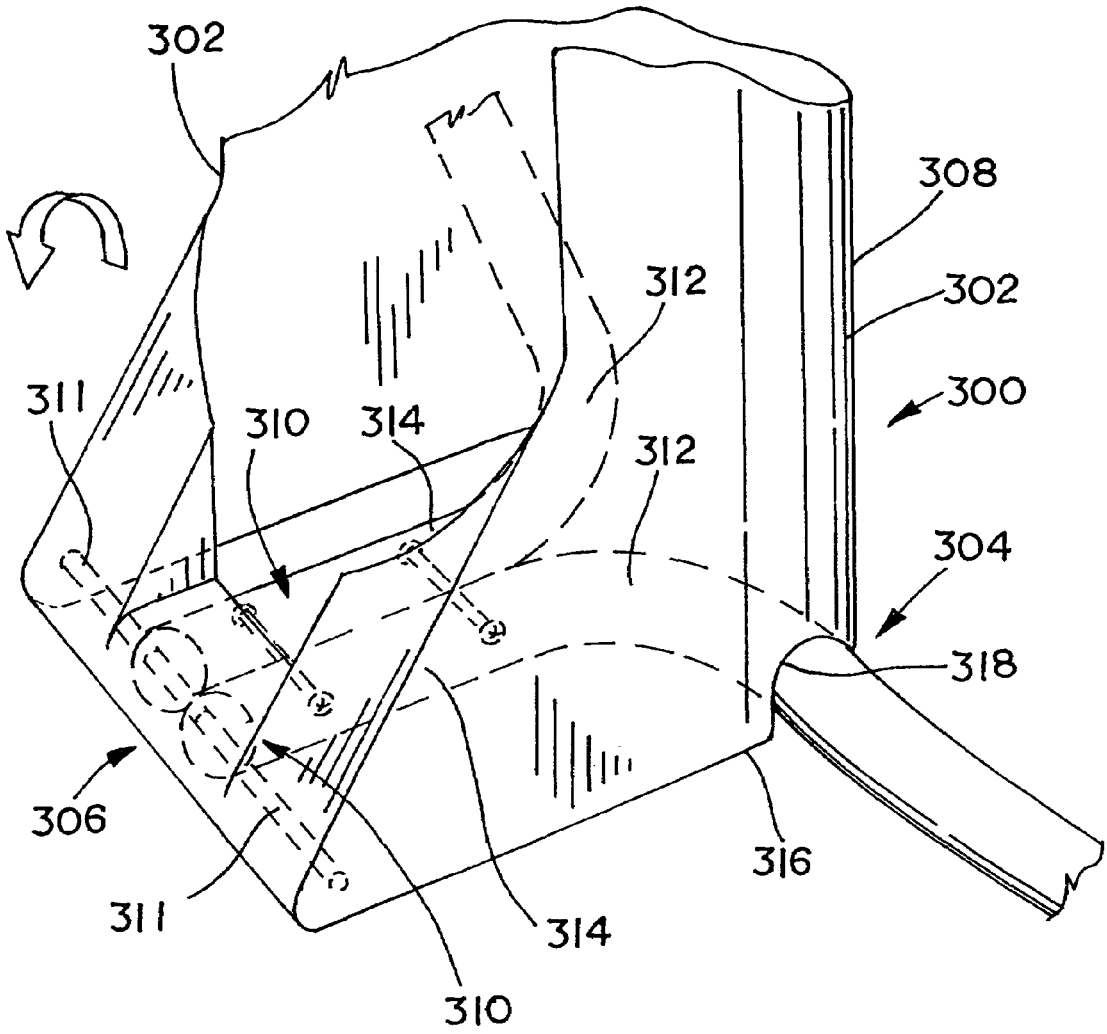
FIG. 19 is a partial cut-away view of one example of a foldable spine for a collapsible child motion device constructed in accordance with the teachings of the present invention.

FIG. 19 shows one of many possible alternative examples for a construction of a spine 300 with a housing 302 that can fold or pivot relative to a base section 304. The components in this example may equate generally to the example shown in FIGS. 10 and 13, each of which has a housing that can pivot or fold relative to the base section parts coupled to it.

In this example, the housing 302 has a front side 306 and a rear side 308 relative to a position of its support arm (not shown) at mid-travel position. The base section 304 has a pair of ends 310 that are coupled to a pivot pin 311 within the front side 306 of the housing 302. The pivot axis of the pin 311 extends laterally side-to-side across the front side of the housing. The ends 310 extend rearward to the rear side 308 of the housing and then curve in opposite directions to opposed bent parts 312. Linear parts 314 of the ends 310 are side-by-side adjacent one another and fixed to one another within the housing to provide stability and rigidity for the base section 302. A bottom edge 316 of the housing 302 has a pair of notches 318 positioned and contoured to accommodate the location and shape of the oppositely extending bent parts 312, which seat within the notches when the device is in the in-use configuration as shown. When the device is to be folded or collapsed, the housing can be rotated forward about the pivot axis of the pin 311 to a position generally co-planar with the base section 304.

Figure 20:
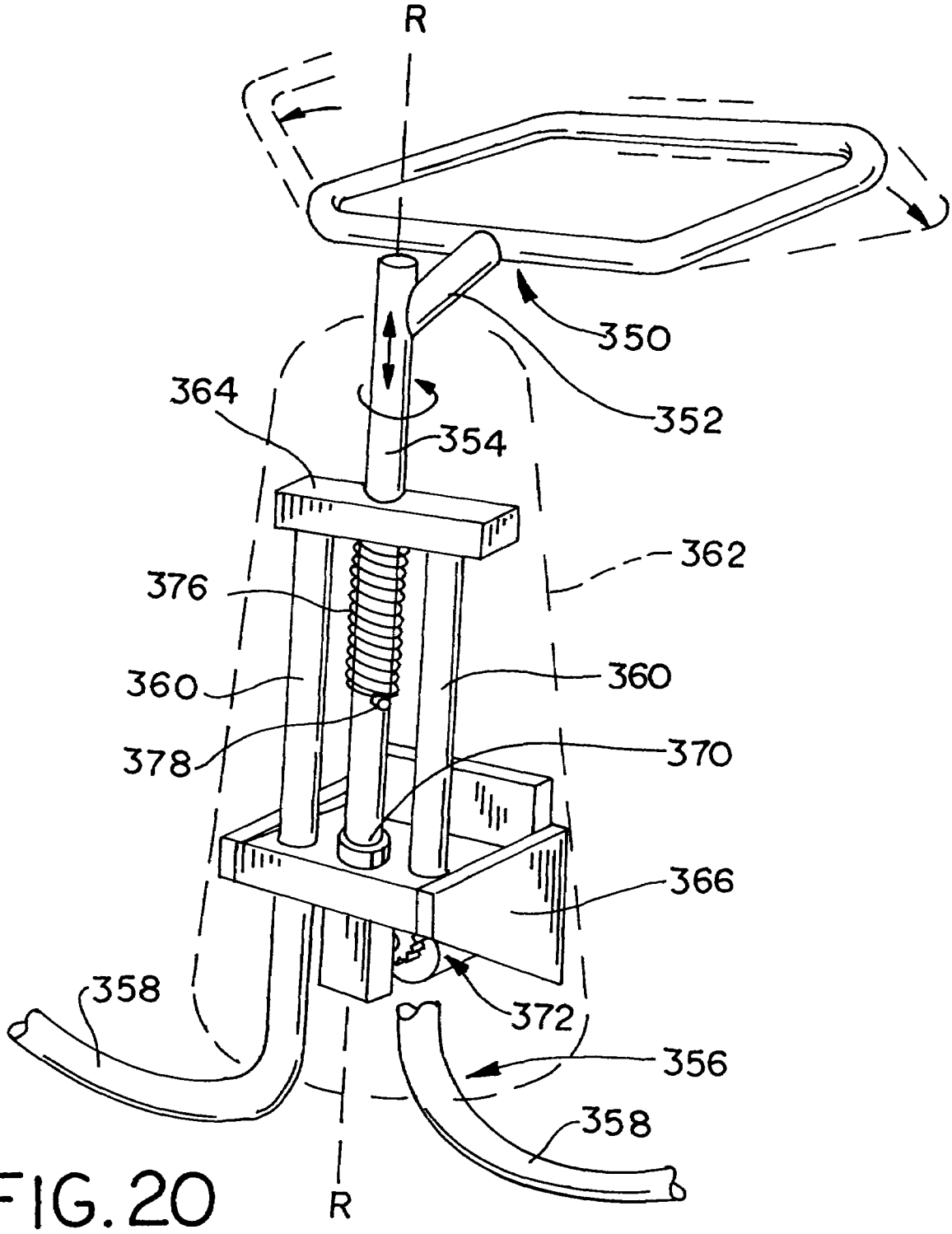
FIG. 20 is a cut-away view of a spine showing one example of the inner workings of a child motion device constructed in accordance with the teachings of the present invention.

FIG. 20 shows one of many possible examples of the inner workings of the spines and housings for the various child motion devices shown and described herein. In this example, a support arm 350 has a driven end 352 coupled to a pivot rod 354. The rod 354 is supported for rotation in a generally vertical orientation about an axis of rotation R. In this example, the frame assembly has a base section 356 with a pair of legs 358 that each terminate in an upwardly extending part 360 within a housing 362 of the device's spine. These frame parts or legs 358 are linear extensions of the base section 356 and are spaced laterally from one another. Their distal ends 362 are connected to and rotationally retained within an upper bearing block 364. Lower regions of these frame parts or legs 358 are rotationally retained in position within a lower bearing block or motor mount 366. In this example, the legs 358 of the base section 356 can be rotated forward or rearward about an axis of the legs within openings of the bearing blocks between in-use and folded configurations. This structure is representative of yet another alternative foldable base section structure.

Each bearing block 364, 366 has a central bearing opening for receiving and rotationally supporting the support arm rod 354. In this example, a lower end 370 of the rod 354 can terminate below the lower bearing block 366 and be coupled to a motor or other drive mechanism 372. The drive mechanism 372 can be configured to reciprocally rotate the rod, and thus the support arm, through a predetermined travel angle, such as 120 degrees as mentioned above. The motor or drive mechanism 372 can include features that can be manipulated by a user to adjust the angular travel, the speed of rotation, and the like. An operator panel, touch pad device, a remote control unit, or user interface can be provided on a portion of the housing 362 with buttons, a touch screen, a keypad, switches, combinations of these features, or the like that a user can manipulate to access, operate, adjust, and alter various performance characteristics of the device. FIG. 1 shows one example of a touch pad or screen 400 carried on a vertically adjustable or telescoping part 402 of the housing 39. The position of the control panel can thus be adjusted to a height more suitable for access by an adult.

In one example, a user interface with a "cap-touch" or capacitive feedback circuit can be employed. The interface senses a change in capacitance near an electronic part of the device, which can be programmed to trigger a signal to an integrated circuit. The capacitance change signal can be design to trigger based on human contact or contact with a metal object that closely approaches the interface or an electronic board. Many advantages could be achieved by this type of user interface. First, the threshold change level can be designed to be child-proof, i.e., to prohibit a child from altering the product settings or operational mode. Also, the same electronics can be utilized within a motion feedback loop. A metal projection or finger can be coupled to any moving part of the seat and can be positioned to move relative to the electronic board as the support arm moves. The electronics can then track or monitor the arm motion through the relative capacitance changes. This feature could be used for product cycle and motion parameter purposes to control the device.

Additional play or entertainment features can also be employed in the disclosed devices. Motion speed options, music and sound options, and other entertainment features can be configured as part of the device. These features can be electronically linked to occur as part of optional, selectable program settings or use modes. For example, a "soothing" setting could be programmed to pre-select music or background sound to accompany a use mode or other product features to create desired characteristics for that setting. Other optional settings can have their own pre-programmed or selectable features as well. Additionally, different play features associated with the devices can be employed in different ways, depending upon the selected child seat orientation. For example, with the seat facing the axis of rotation R of the support arm, the child's field of view will essentially always be the spine and its housing. An entertainment device, a toy, a video screen such as an LCD screen, or the like can be mounted on or part of the housing to entertain the child as they move. Toys or other play features can also be provided as part of or attachable to the child seat 36, if desired.

Though not shown in detail herein, the components of the drive mechanism 372 can vary considerably and yet fall within the spirit and scope of the present invention. In one example tested and proven to function properly, the drive mechanism can be in the form of an electromechanical system coupled to the rod 354 to generate the desired motion. In one example, an electric DC or AC motor can be coupled to a worm gear, which can then be coupled to a worm gear follower. The follower can drive a crank shaft. The energy of the drive shaft can be transformed from pure rotary motion to an oscillating or reciprocating motion through a notched bracket, which in turn is coupled to a spring. The spring can be coupled to the rod 354 to oscillate the support arm through its motion.

The spring (not shown) can act as a rotary dampening mechanism as well as an energy reservoir. The spring can be implemented to function as a clutch-like element to protect the motor by allowing out-of-sync motion between the motor and rod 354. Thus, the rod 354 need not be directly connected to the motor. There are certainly many other possible drive mechanisms or systems that can also be employed to impart the desired oscillatory or reciprocating motion to the support arm of the devices disclosed herein. These can include spring-operated wind-up mechanisms, magnetic systems, electromagnetic systems, or other devices to convert drive mechanism energy and motion to the reciprocating or oscillating motion of the disclosed devices. In each case, the construction of the devices disclosed herein allow the drive system parts to be housed in a housing and positioned below the child seat level. The mechanisms are thus out of the way, resulting in reduced noise levels to an occupant, a highly compact product configuration, and virtually unimpeded access to the child seat.

Also depicted in FIG. 20 is one example of a structure that can induce a bouncer feature to the device. In this example, a spring 376 is captured between the upper bearing block 368 and spring stops 378 positioned on the rod 354. The drive mechanism can be configured to impart a vertical movement or oscillation to the lower end 370 of the rod 354 along its axis. The spring 376 can dampen but assist in retaining oscillatory bouncer movement to the support arm. Alternatively, the rod 354 and spring 376 can simply be mechanically constructed to permit movement of the seat in the support arm 356 to create occasional bouncing motion. A child's motion or a parent's touch can impart such mechanical bouncing motion.

The details of the various child motion device examples disclosed herein can vary considerably and yet fall within the spirit and scope of the present invention. The construction and materials used to form the frame assembly parts, the spine parts, and the added features can vary from plastics, to steel tubing, to other suitable materials and part structures. The drive system components can also vary, as can the features employed in the drive system to create desired motions and functions for the disclosed devices. The housing can have a top cap that rotates with and/or is integrally a part of the swing arm. Alternatively, the housing can provide a platform on the top or on a side of the spine such that the driven end of the support arm is supported by the platform and rotates relative to the platform.

The child seat bottom or base can be configured so that it engages with the seat holder in any suitable manner. As disclosed herein, vertical or vertically angled notches can be provided in the seat base. The size of the seat holder tubes or other materials can be configured to slip into the notches to engage with the seat. Gravity and the weight of a child can be enough to retain the seat in the holder. However, positive latching structures can be employed if desired. The seat can also be configured to include common features such as a harness system, carrying handles, a pivotable tray, and a hard plastic shell. The base of the seat can have a rocking, bouncing, or stationary support structure configuration and the seat can employ a pad, cover, or other suitable soft goods. As noted above, the seat holder can be configured to hold other devices such as a bassinet or other child supporting device.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device. In another example, the child seat could be fixed to the support arm and not removable.

Also, though not shown in detail herein, each foldable joint of the frame assemblies can have positive locking or detent mechanisms to retain or lock the devices in either or both the in-use and the folded configurations. The joints can be gear-type joints, a combination of spring biased locking pins, pivot joints, and apertures, or other latching mechanisms. Alternatively, the devices disclosed herein need not be foldable at all, if desired, but instead can be constructed so that they can not be collapsed without disassembly of the components. Quick disconnect joints can be employed so that the device can be easily broken down for transport or storage. The seat holder can even be separately detachable and replaceable with other seat holders of different configuration to accommodate different child supporting devices, if desired.

Although certain child motion devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child motion device comprising:

a frame assembly configured to rest on a floor surface;

a drive system defining a generally vertical axis of rotation; and a support arm supported above the floor surface by the frame assembly and cantilevered from the axis of rotation, the support arm having a driven end coupled to and movable by the drive system, the drive system configured to pivotally reciprocate the support arm through a partial orbit around the generally vertical axis of rotation and to accept a child supporting device for movement with the support arm, wherein the arm travels within a travel plane that is tilted at an angle of greater than 0 degrees relative to the floor surface such that the child supporting device reciprocates through an arc that has a mid-point positioned nearer the floor surface than extreme ends of the arc.

2. A child motion device according to claim 1, wherein the child supporting device is a removable seat.

3. A child motion device according to claim 1, wherein the frame assembly further comprises:

a base section that can be arranged to lie on the floor surface; and a spine that can be arranged to extend upward from the base section away from the floor surface and wherein the support arm is cantilevered from a part of the spine.

4. A child motion device according to claim 1, wherein the support arm has a seat holder on a distal end configured to receive and support a child seat as the child supporting device in more than one optionally selectable seat facing orientations.

5. A child motion device according to claim 4, wherein the child seat can rest on the seat holder in four seat facing orientations including a first orientation facing the support arm, a second orientation facing away from the support arm, a third orientation with the support arm positioned on the left side of the child seat, and a fourth orientation with the support arm positioned on the right side of the child seat.

6. A child motion device according to claim 4, wherein the seat holder is a ring surrounding an opening and is configured to accept a child seat with a depending part that sets within the opening and with additional parts that rest on and engage with the ring in any selected rotational seat facing orientation.

7. A child motion device according to claim 1, wherein the child supporting device is a removable seat configured to be readily secured for use in another device selected from a group consisting of a stroller, a pendulum swing, a bouncer, and a car seat.

8. A child motion device according to claim 1, wherein the arm rotates reciprocally around the axis of rotation about the driven end and the arc is about 120 degrees.

9. A child motion device according to claim 1, wherein the generally vertical axis of rotation of the arm is oriented at an angle of about 15 degrees relative to a vertical reference plane and leans in a direction toward the mid-point of the arc.

10. A child motion device according to claim 1, wherein the child supporting device is a removable seat that can be adjustably reclined.

11. A child motion device according to claim 1, wherein the child supporting device is a removable seat with one or more latches that positively and removably engage with a part of the support arm.

12. A child motion device according to claim 1, further comprising:

a touch pad device on a portion of the frame assembly and electronically coupled to the drive system to control at least movement of the support arm.

13. A child motion device according to claim 12, wherein the touch pad device is a child-proof capacitive touch screen.

14. A child motion device according to claim 1, wherein the drive system includes a motor.

15. A child motion device according to claim 1, wherein the partial orbit is less than 180 degrees around the generally vertical axis of rotation.

16. A child motion device according to claim 1, wherein the frame assembly further comprises:

a base section configured to lie on the floor surface; and a spine extending up from the base section away from the floor surface, the spine positioned at one edge of the base section and the support arm cantilevered from a part of the spine over the base section.

17. A child motion device according to claim 1, wherein the drive system is operable to alter one or more motion characteristics of the support arm.

18. A child motion device comprising:

a frame assembly configured to rest on a floor surface;

a drive system defining a generally vertical axis of rotation; and a support arm supported above the floor surface by the frame assembly and cantilevered from the axis of rotation, the support arm having a driven end coupled to and movable by the drive system, the drive system configured to pivotally reciprocate the support arm through a partial orbit around the generally vertical axis of rotation and to accept a child supporting device for movement with the support arm, wherein the support arm travels within a travel plane and an angle of the travel plane is adjustable relative to the floor surface.

19. A child motion device comprising:

a frame assembly configured to rest on a floor surface, the frame assembly including a base section having a perimeter ring surrounding a space that is substantially open, the perimeter ring configurable to rest on the floor surface, and including a spine positioned along and extending upward from part of the perimeter ring;

a drive system defining a generally vertical axis of rotation and being housed in an interior of a housing of the spine; and a support arm supported above the floor surface by the frame assembly and cantilevered from the axis of rotation, the support arm having a driven end coupled to and movable by the drive system, the drive system configured to pivotally reciprocate the support arm through a partial orbit around the generally vertical axis of rotation and to accept a child supporting device for movement with the support arm.

20. A child motion device according to claim 19, wherein the base section and the support arm are each reconfigurable to a folded condition lying closely spaced to and generally parallel to the spine in the folded condition.

21. A child motion device according to claim 19, wherein the base section and the spine are pivotally coupled to one another and can be folded to a condition lying generally parallel to one another.

22. A child motion device comprising:

a frame assembly configured to rest on a floor surface;

a drive system defining a generally vertical axis of rotation;

a support arm supported above the floor surface by the frame assembly and cantilevered from the axis of rotation, the support arm having a driven end coupled to and movable by the drive system, the drive system configured to pivotally reciprocate the support arm through a partial orbit around the generally vertical axis of rotation and to accept a child supporting device for movement with the support arm; and a touch pad device on a portion of the frame assembly and electronically coupled to the drive system to control at least movement of the support arm, wherein the touch pad device is carried on a telescoping, vertically adjustable part of the frame assembly.

23. A child motion device comprising:

a frame assembly having a base section configured to rest on a floor surface that lies in a generally horizontal reference plane and having an upright section extending upward from a part of the base section and defining a generally vertical axis of rotation;

a drive system carried within a housing of the upright section; and a support arm with a driven end coupled to the upright section and movable by the drive system, the support arm cantilevered radially outward relative to the axis of rotation, the support arm having a seat support spaced from the driven end and configured to support a child above the floor surface and being pivotally movable about the driven end to move the child through a reciprocating arc of less than 180 degrees around the axis of rotation, wherein the axis of rotation of the arm is oriented at an acute angle relative to the generally horizontal reference plane and in the direction of the reciprocating arc.

24. A child motion device according to claim 23, wherein the frame assembly is reconfigurable between an in-use condition and a more compact folded condition.

25. A child motion device according to claim 23, further comprising:

a seat holder on the arm configured to accept a child seat with a child supporting surface.

26. A child motion device according to claim 25, wherein the child seat can be removed from the seat holder and can be attached to the seat holder in a plurality of different selectable seat facing orientations.

* * * * *

UNITED STATES PATENT AND TRADEMARK OFFICE

CERTIFICATE OF CORRECTION

PATENT NO. : 7,563,170 B2
APPLICATION NO. : 11/385260
DATED : July 21, 2009
INVENTOR(S) : William B. Bellows et al.

It is certified that error appears in the above-identified patent and that said Letters Patent is hereby corrected as shown below:

Title page, Item (73)

please delete the word "Graca" and replace with --Graco--.

Signed and Sealed this

Third Day of August, 2010

David J. Kappos

David J. Kappos
*Director of the United States Patent and Trademark Office*